US010777952B2

(12) United States Patent
Chien et al.

(10) Patent No.: US 10,777,952 B2
(45) Date of Patent: Sep. 15, 2020

(54) ELECTRICAL PLUG CONNECTOR

(71) Applicant: ADVANCED-CONNECTEK INC., New Taipei (TW)

(72) Inventors: Min-Lung Chien, New Taipei (TW); Ming-Yung Chang, New Taipei (TW); Mao-Sheng Chen, New Taipei (TW); Cheng-Che Tsai, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 16/502,902

(22) Filed: Jul. 3, 2019

(65) Prior Publication Data

US 2020/0014158 A1 Jan. 9, 2020

(30) Foreign Application Priority Data

Jul. 4, 2018 (TW) ..... 107209072 U

(51) Int. Cl.
*H01R 13/658* (2011.01)
*H01R 24/60* (2011.01)
*H01R 13/6581* (2011.01)

(52) U.S. Cl.
CPC ..... *H01R 24/60* (2013.01); *H01R 13/6581* (2013.01)

(58) Field of Classification Search
CPC ..... H01R 13/6581; H01R 24/60
USPC ..... 439/660
See application file for complete search history.

(56) References Cited

U.S. PATENT DOCUMENTS 9,450,337 B2 * 9/2016 Kao ..... H01R 13/6461
9,466,930 B2 * 10/2016 Little ..... H01R 24/60
9,472,910 B2 * 10/2016 Little ..... H01R 24/60
9,478,923 B2 * 10/2016 Kao ..... H01R 24/60
9,490,584 B2 * 11/2016 Little ..... H01R 13/6581
9,577,360 B2 * 2/2017 Kao ..... H01R 12/722
9,614,333 B2 * 4/2017 Tsai ..... H01R 24/70
9,620,904 B2 * 4/2017 Kao ..... H01R 13/5202
9,620,909 B2 * 4/2017 Kao ..... H01R 13/6585
9,634,437 B2 * 4/2017 Kao ..... H01R 13/6471
9,640,923 B2 * 5/2017 Kao ..... H01R 12/724
9,647,369 B2 * 5/2017 Tsai ..... H01R 4/02
9,647,396 B2 * 5/2017 Tsai ..... H01R 12/716
9,660,399 B2 * 5/2017 Hsu ..... H01R 24/60
9,685,739 B2 * 6/2017 Chen ..... H01R 13/6585
9,728,916 B1 * 8/2017 Tsai ..... H01R 24/60
9,735,511 B2 * 8/2017 Kao ..... H01R 13/5202
9,799,999 B1 * 10/2017 Tsai ..... H01R 12/57
9,843,148 B2 * 12/2017 Little ..... H01R 24/60
9,923,286 B2 * 3/2018 Cheng ..... H01R 13/405
(Continued)

*Primary Examiner* — Abdullah A Riyami
*Assistant Examiner* — Vladimir Imas
(74) *Attorney, Agent, or Firm* — Muncy, Geissler, Olds & Lowe, P.C.

(57) ABSTRACT

An electrical plug connector includes a first terminal module, a second terminal module, and a metallic contact member. The first terminal module and the second terminal module are received in a metallic shell. The metallic contact member is between the first terminal module and the second terminal module. The metallic contact member separates the first terminal module from the second terminal module. Moreover, two ends of the metallic contact member are respectively in contact with the ground terminals of the first plug terminals or in contact with the ground terminals of the second plug terminals.

20 Claims, 13 Drawing Sheets

(56) References Cited

U.S. PATENT DOCUMENTS

| | | | | |
|---|---|---|---|---|
| 10,096,961 | B2 * | 10/2018 | Zhao | H01R 13/6581 |
| 10,128,596 | B2 * | 11/2018 | Tsai | H01R 12/716 |
| 10,141,693 | B2 * | 11/2018 | Zhao | H01R 12/727 |
| 10,170,867 | B2 * | 1/2019 | Ju | H01R 13/6583 |
| 10,205,290 | B2 * | 2/2019 | Tsai | H01R 13/502 |
| 10,297,943 | B2 * | 5/2019 | Hou | B29C 45/00 |
| 10,312,635 | B2 * | 6/2019 | Zhao | H01R 43/16 |
| 2014/0024257 | A1 * | 1/2014 | Castillo | H01R 13/6585 439/607.05 |
| 2016/0104972 | A1 * | 4/2016 | Feng | H01R 13/6581 439/607.27 |

* cited by examiner

ELECTRICAL PLUG CONNECTOR

CROSS-REFERENCE TO RELATED APPLICATION

This non-provisional application claims priority under 35 U.S.C. § 119(a) to patent application Ser. No. 10/7,209,072 in Taiwan, R.O.C. on Jul. 4, 2018, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A USB type-C electrical plug connector known to the inventor includes a plastic core, upper and lower plug terminals held on the plastic core, an outer iron shell circularly enclosing the plastic core, and conductive sheets held on the plastic core.

SUMMARY OF THE INVENTION

Upon signal transmission, high-frequency noises produced by upper and lower terminals of a USB type-C electrical plug connector known to the inventor may resonate with nearby radio-frequency signals easily via the grounding loops of the connector, and the operations of the peripheral devices among the connector may be affected.

In view of this, an embodiment of the instant disclosure provides an electrical plug connector. The electrical plug connector comprises a metallic shell, a first terminal module, a second terminal module, and a metallic contact member. The first terminal module comprises a first insulated member and a plurality of first plug terminals. An inner surface of the first insulated member comprises a plurality of first terminal grooves for positioning the first plug terminals. The second terminal module is assembled with the first terminal module and received in a receiving cavity of the metallic shell. The second terminal module comprises a second insulated member and a plurality of second plug terminals. An inner surface of the second insulated member comprises a plurality of second terminal grooves for positioning the second plug terminals. The contact member is between the first plug terminals and the second plug terminals. Two ends of the contact member respectively comprise a contact finger. The contact fingers contact first ground terminals of the first plug terminals or contact second ground terminals of the second plug terminals.

In one or some embodiments, each of the contact fingers at the two ends of the metallic contact member has an elastic arm extending outwardly.

In one or some embodiments, the first insulated member comprises a first combining block formed on the inner surface of the first insulated member to retain the first plug terminals. Two ends of the first combining block comprise a plurality of recesses for receiving the elastic arms.

In one or some embodiments, each of the first plug terminals comprises a first flexible contact portion, a first body portion, and a first tail portion. Each of the first body portions is held in the first combining block. The first body portion of each of the first ground terminals is in contact with the corresponding elastic arm. Each of the first flexible contact portions is extending forward from the corresponding first body portion in the rear-to-front direction, and each of the first tail portions is extending backward from the corresponding first body portion in the front-to-rear direction and extending out of the first combining block.

In one or some embodiments, the metallic contact member comprises a grounding plate and a separation plate separated with each other. The grounding plate is between the first insulated member and the second insulated member, and two ends of the separation plate comprise the contact fingers.

In one or some embodiments, the separation plate comprises a plurality of engaging members extending outwardly, and at least one of the engaging members is in contact with the grounding plate.

In one or some embodiments, the second insulated member comprises a second combining block formed on the inner surface of the second insulated member to retain the second plug terminals. Two ends of the second combining block comprise a plurality of buckling grooves for receiving the engaging members.

In one or some embodiments, each of the second plug terminals comprises a second flexible contact portion, a second body portion, and a second tail portion. Each of the second body portions is held in the second combining block, the second body portion of each of the second ground terminals is in contact with the corresponding elastic arm. Each of the second flexible contact portions is extending forward from the corresponding second body portion in the rear-to-front direction, and each of the second tail portions is extending backward from the corresponding second body portion in the front-to-rear direction and extending out of the second combining block.

In one or some embodiments, each of the first ground terminals comprises a first bending portion contacting the metallic contact member, and each of the second ground terminals comprises a second bending portion contacting the metallic contact member.

Another embodiment of the instant disclosure provides an electrical plug connector. The electrical plug connector comprises a metallic shell, a first terminal module, a second terminal module, and a metallic contact member. The first terminal module comprises a first insulated member and a plurality of first plug terminals. An inner surface of the first insulated member comprises a plurality of first terminal grooves in a vertical direction for positioning the first plug terminals. The second terminal module is assembled with the first terminal module and received in a receiving cavity of the metallic shell. The second terminal module comprises a second insulated member and a plurality of second plug terminals. An inner surface of the second insulated member comprises a plurality of second terminal grooves in the vertical direction for positioning the second plug terminals. The metallic contact member is between the first insulated member and the second insulated member, and the metallic contact member is between the first plug terminals and the second plug terminals. The metallic contact member comprises at least one contact finger, and the at least one contact finger contacts one of first ground terminals of the first plug terminals or one of second ground terminals of the second plug terminals. The metallic contact member further comprises a grounding plate and a separation plate. The grounding plate further comprises a pair of side latches. Each of the pair of the side latches comprises a locking head and a side arm. The side arms are extending forwardly from two sides of the grounding plate and sidewardly extending inwardly toward the insertion cavity in a transverse direction perpendicular to the vertical direction, so that the side arms are adapted to lock with a metallic shielding plate of an electrical receptacle connector into which the electrical plug connector is inserted.

In one or some embodiments, the separation plate comprises the at least one contact finger, and the at least one contact finger contacts one of the first ground terminals or one of the second ground terminals.

In one or some embodiments, the separation plate comprises at least one engaging member extending outwardly and the at least one engaging member is in contact with the grounding plate.

In one or some embodiments, the first insulated member comprises a first combing block formed on the inner surface of the first insulated member to retain the first plug terminal. Two ends of the first combining block comprise a plurality of recesses for receiving the at least one contact fingers.

In one or some embodiments, the separation plate comprises a plurality of engaging members extending outwardly. At least one of the engaging members is in contact with the grounding plate.

In one or some embodiments, the second insulated member comprises a second combining block formed on the inner surface of the second insulated member to retain the second plug terminals. Two ends of the second combining block comprise a plurality of buckling grooves for receiving the engaging members.

In one or some embodiments, the first insulated member comprises a first combining block formed on the inner surface of the first insulated member to retain the first plug terminals, the second insulated member comprises a second combining block formed on the inner surface of the second insulated member to retain the second plug terminals. A pair of protruding posts and a pair of assembled holes are respectively formed on one side of the first combining block and one side of the second combining block in the vertical direction. The grounding plate has through holes for inserting the protruding posts. The pair of protruding posts and the pair of assembled holes are mated with each other, the assemble the first insulated member, the grounding plate, and the second insulated member together.

In one or some embodiments, the electrical plug connector further comprises a first conductive sheet and a second conductive sheet. The first conductive sheet is combined with an outer surface of the first insulated member. The second conductive sheet is combined with an outer surface of the second insulated member. The first conductive sheet comprises a plurality of first elastic arms inserted into the insertion cavity. The second conductive sheet comprises a plurality of second elastic arms inserted into the insertion cavity.

In one or some embodiments, the first conductive sheet further comprises a plurality of protruding points contacting an inner surface of the metallic shell, and the second conductive sheet further comprises a plurality of protruding points contacting the inner surface of the metallic shell.

According to one or some embodiment of the instant disclosure, the contact member is between the first insulated member and the second insulated member, and the contact member is also between the first plug terminals and the second plug terminals. Hence, the contact member separates the first plug terminals from the second plug terminals. Furthermore, the two ends of the contact member are respectively in contact with the ground terminals of the first plug terminals or in contact with the ground terminals of the second plug terminals. Accordingly, because of the contact between the contact member and the ground terminal, high-frequency noises can be prevented from resonating with the nearby radio-frequency signals via the grounding loops of the electrical plug connector when the electrical plug connector transmits signals.

Furthermore, the first plug terminals and the second plug terminals are arranged upside down, and the pin-assignment of the flexible contact portions of the first plug terminals is left-right reversal with respect to that of the flexible contact portions of the second plug terminals. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
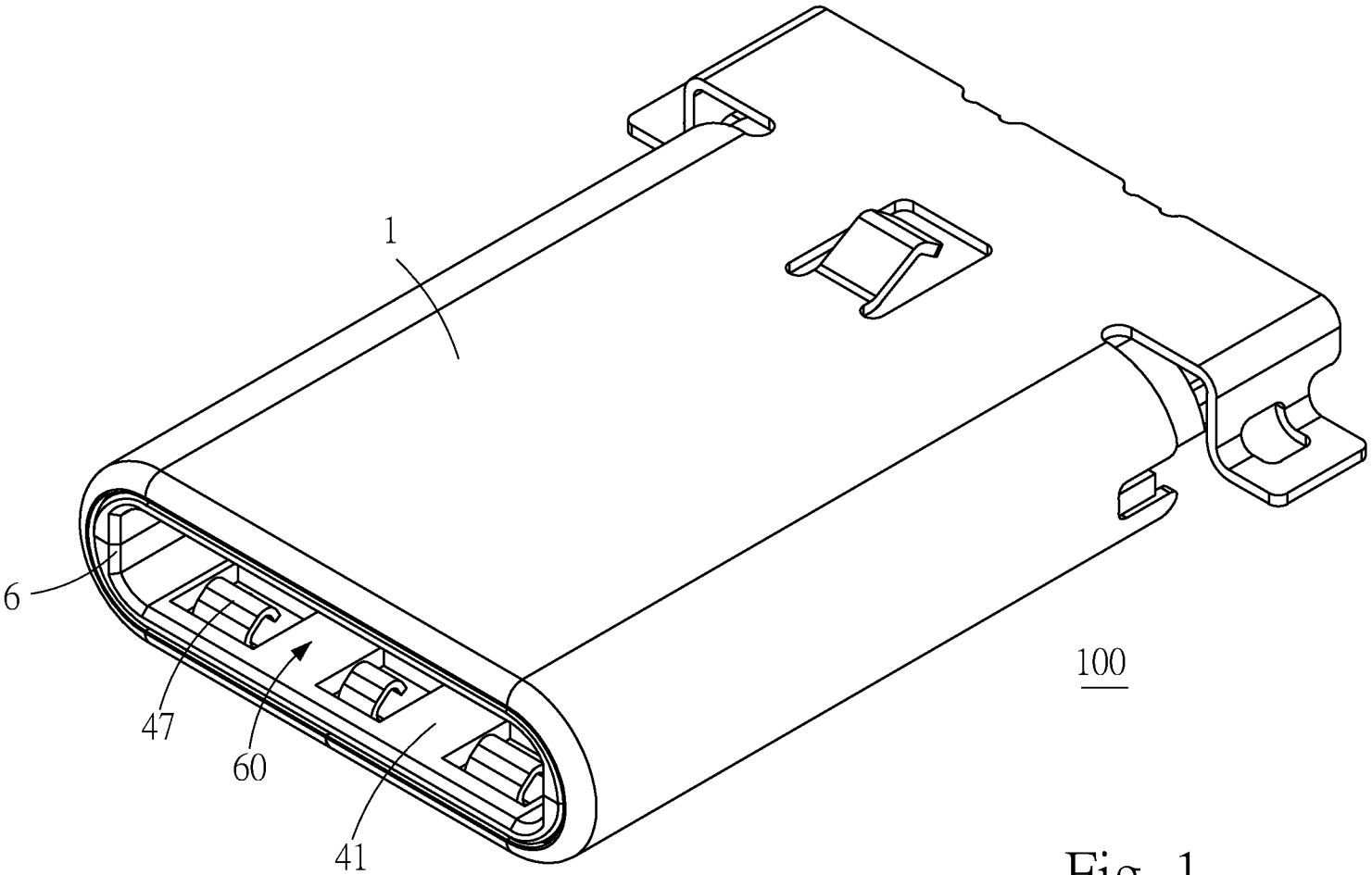
FIG. 1 illustrates a perspective view of an electrical plug connector according to an exemplary embodiment of the instant disclosure.
Figure 2:
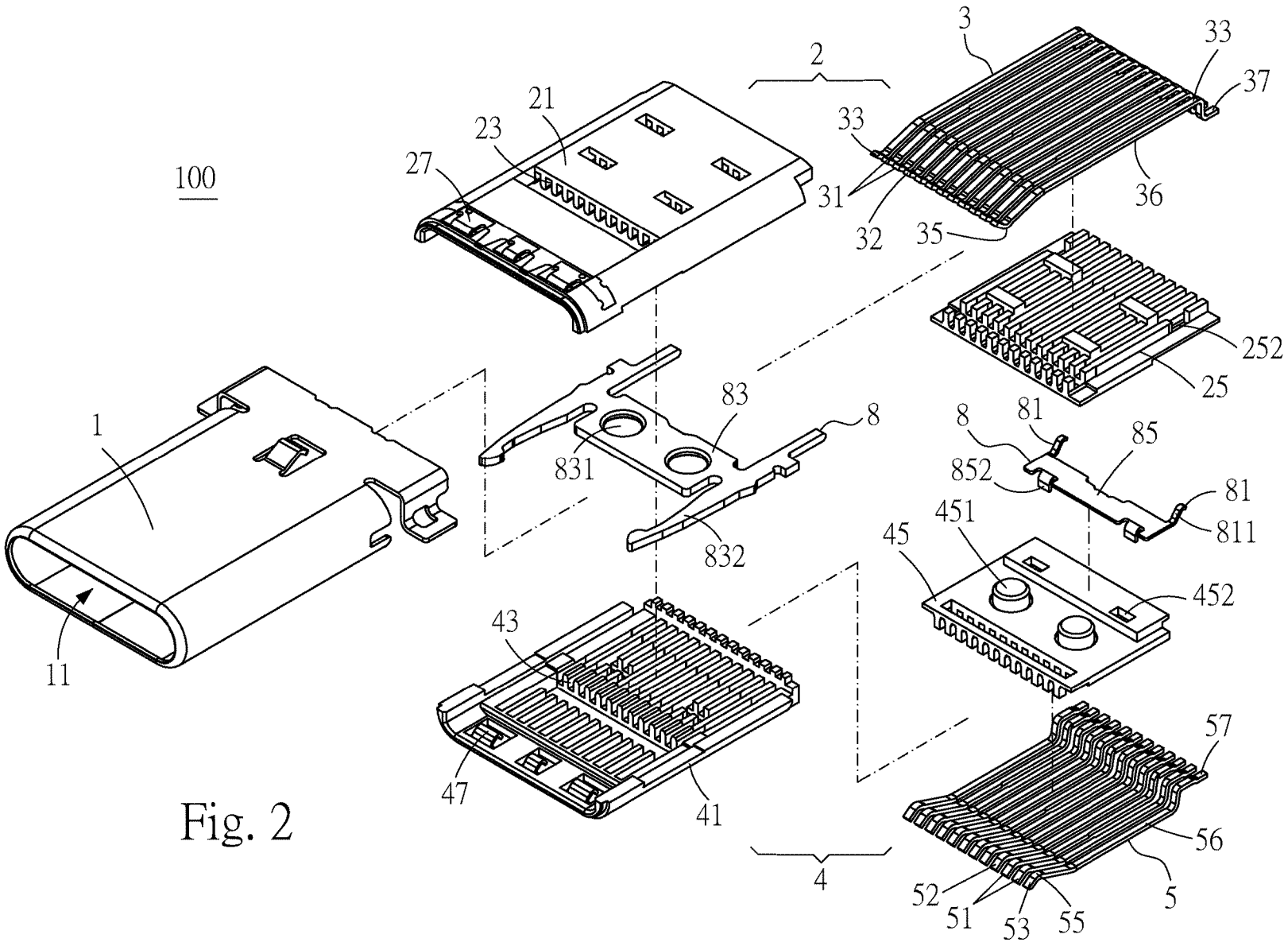
FIG. 2 illustrates an exploded view (1) of the electrical plug connector of the exemplary embodiment.
Figure 3:
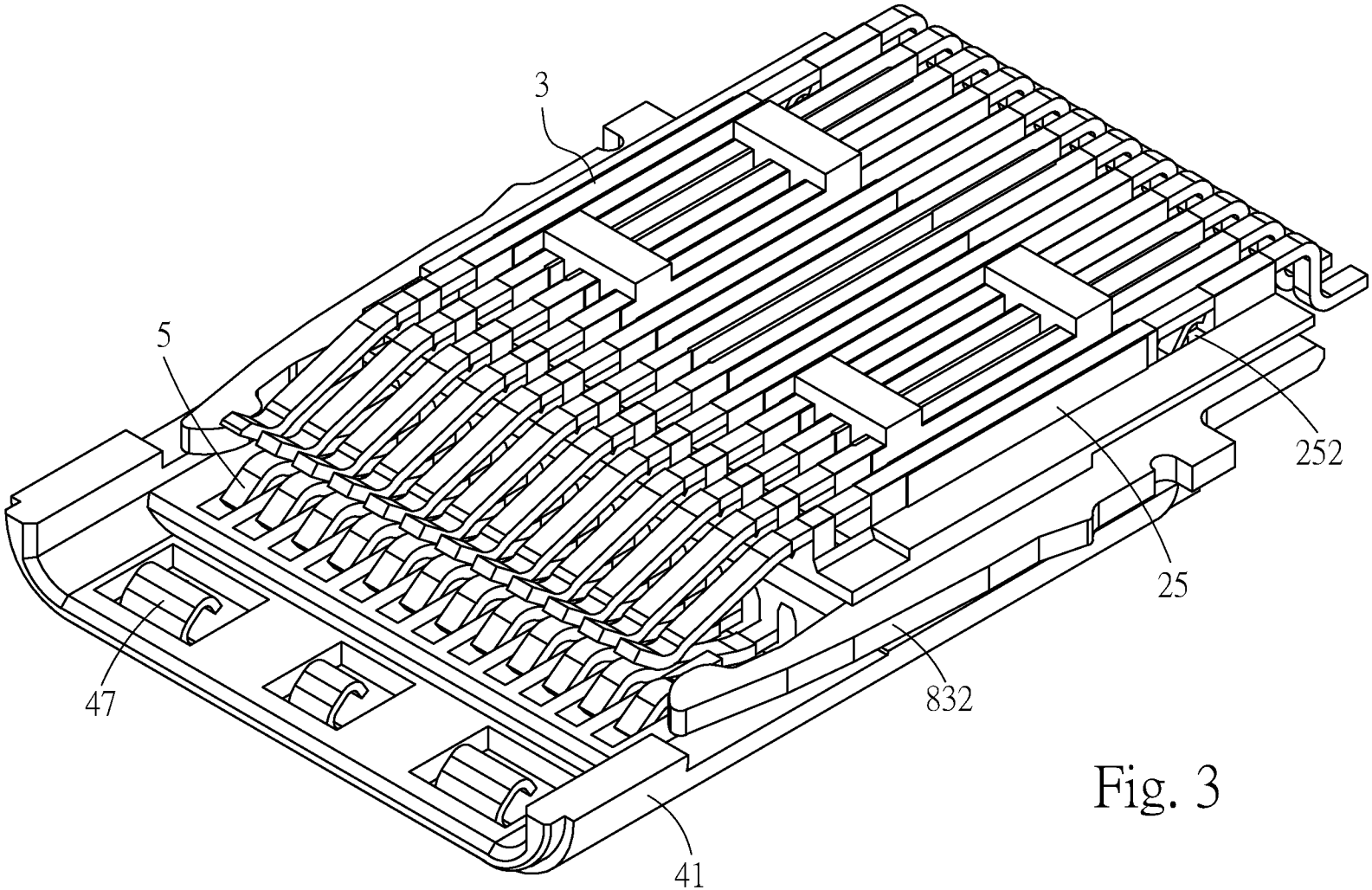
FIG. 3 illustrates a partial assembled view of the electrical plug connector of the exemplary embodiment.

Please refer to FIGS. 1 to 3, illustrating an electrical plug connector 100 according to an exemplary embodiment of the instant disclosure. FIG. 1 illustrates a perspective view thereof, FIG. 2 illustrates an exploded view (1) thereof, and FIG. 3 illustrates a partial assembled view thereof. In this embodiment, the electrical plug connector 100 can provide a reversible or dual orientation USB Type-C connector interface and pin assignments, i.e., a USB Type-C plug connector. Furthermore, the electrical plug connector 100 may be assembled with a circuit board and provided as a flash disk, but embodiments are not limited thereto. In one embodiment, the electrical plug connector 100 may be used in a transmission cable. In this embodiment, the electrical plug connector 100 comprises a metallic shell 1, a first terminal module 2, a second terminal module 4, and a metallic contact member 8.

Figure 5:
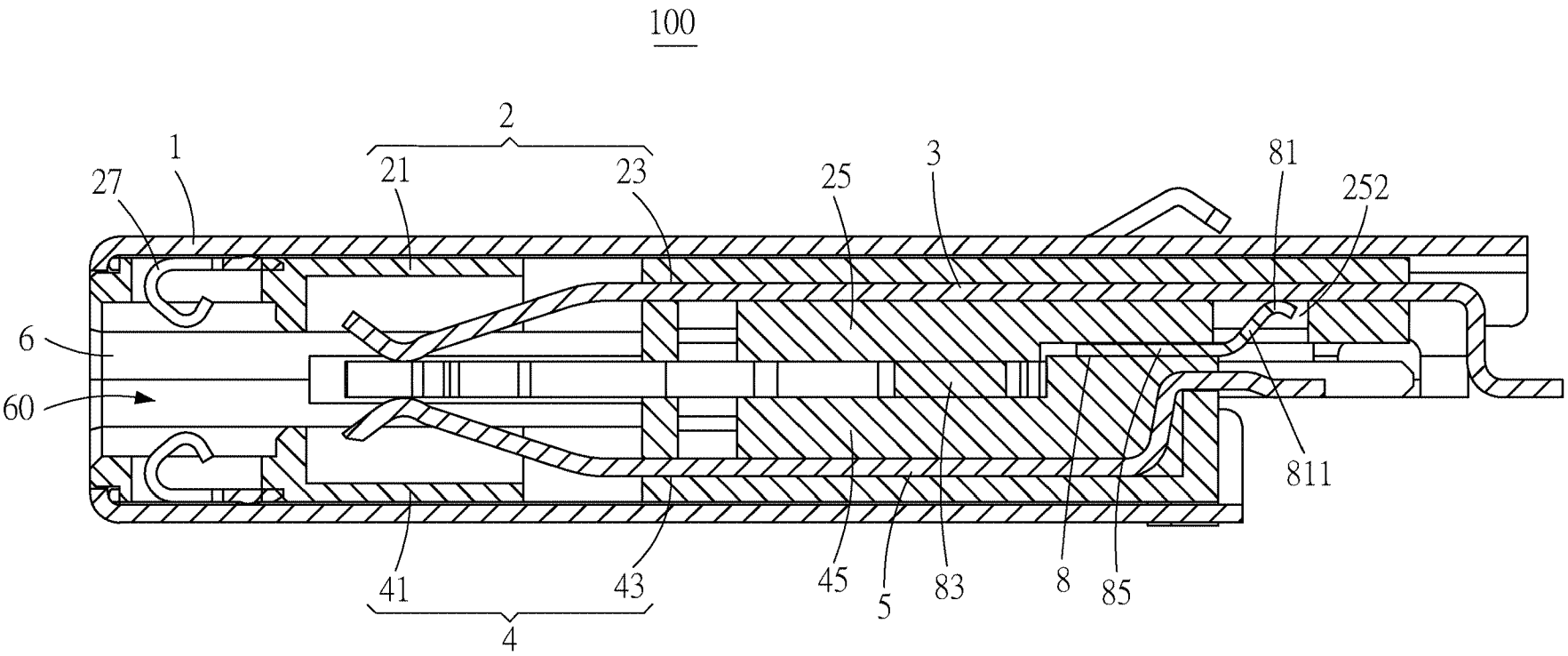
FIG. 5 illustrates a lateral sectional view of the electrical plug connector of the exemplary embodiment.

Please refer to FIGS. 1, 2, and 5. FIG. 5 illustrates a lateral sectional view of the electrical plug connector 100 of the exemplary embodiment. In this embodiment, the metallic shell 1 is a hollowed shell. The metallic shell 1 comprises a receiving cavity 11. The first terminal module 2 and the second terminal module 4 are received in the receiving cavity 11 of the metallic shell 1.

Figure 4:
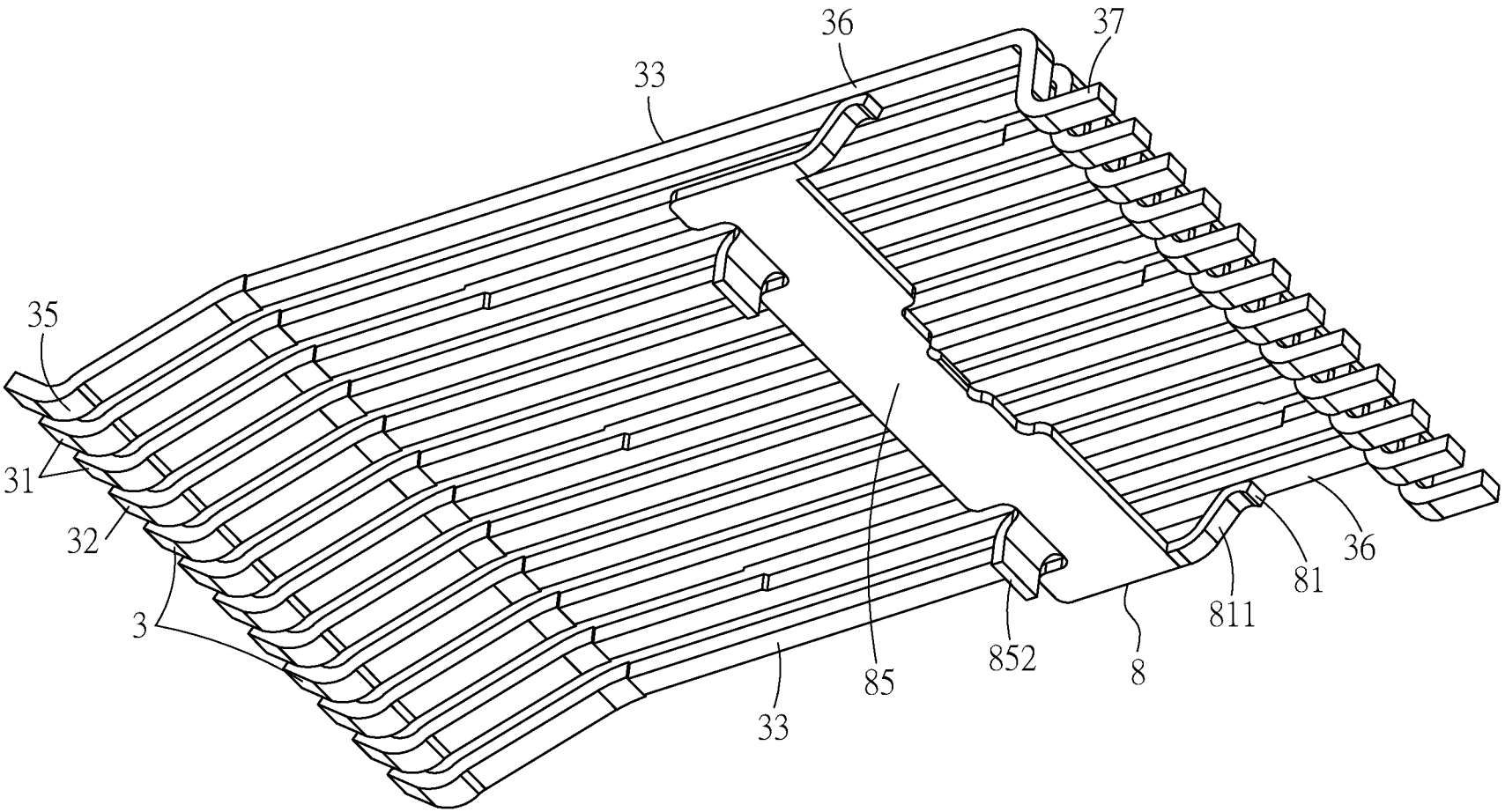
FIG. 4 illustrates a perspective view showing that a contact member is in contact with a first ground terminal, according to the electrical plug connector of the exemplary embodiment.
Figure 6:
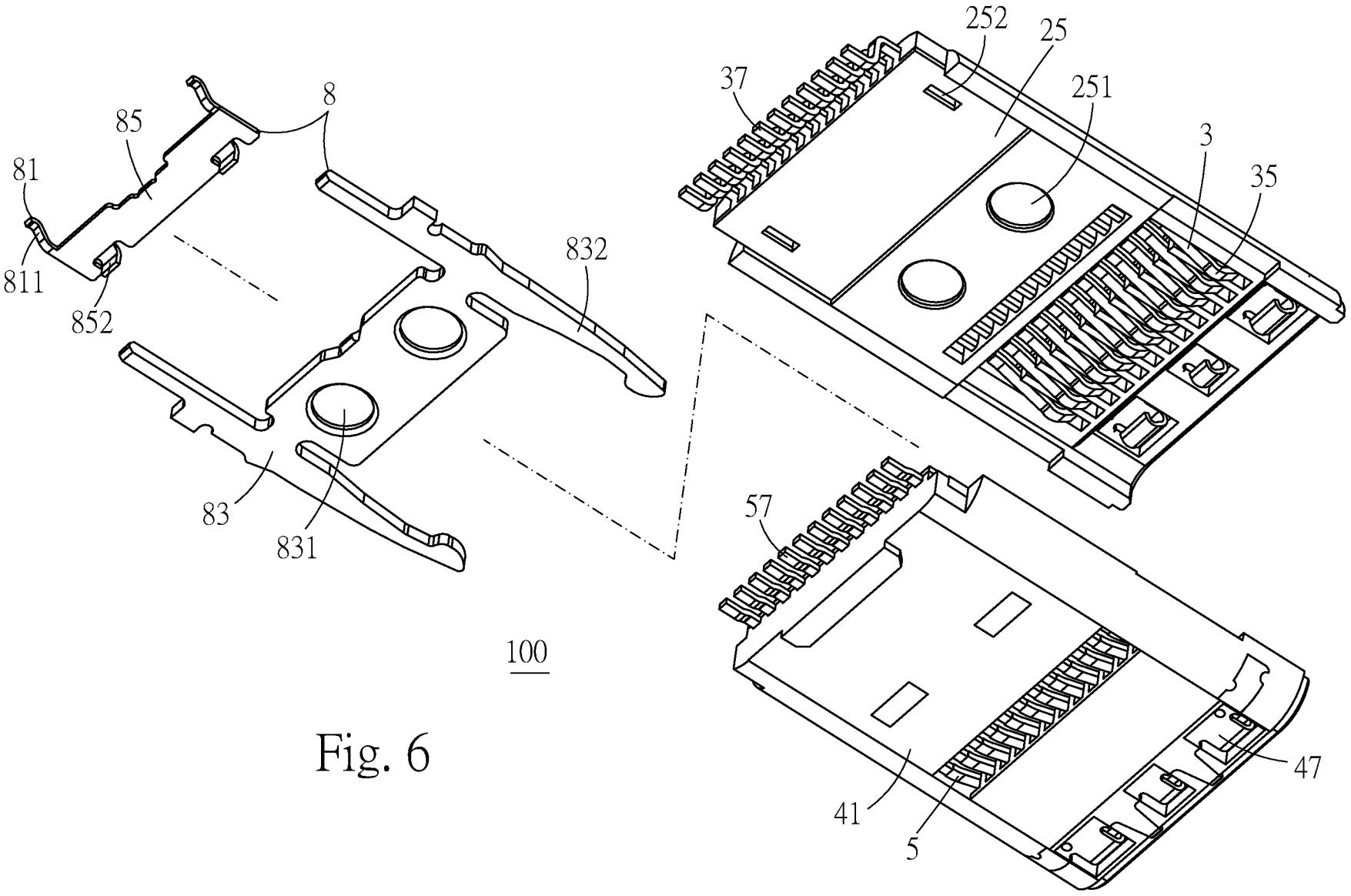
FIG. 6 illustrates an exploded view (2) of the electrical plug connector of the exemplary embodiment.

Please refer to FIGS. 2 to 6. FIG. 4 illustrates a perspective view showing that the metallic contact member 8 is in contact with a first ground terminal 33 of the first terminal module 2. FIG. 6 illustrates an exploded view (2) of the electrical plug connector 100 of the exemplary embodiment. In this embodiment, the first terminal module 2 comprises a first insulated member 21, a plurality of first plug terminals 3, a first combining block 25, and a first conductive sheet 27. The first conductive sheet 27 is a metallic member and is formed on the first insulated member 21. The first conductive sheet 27 is a EMC (Electromagnetic Compatibility) spring which is a shielding strip having EMC spring fingers. The first insulated member 21 is combined with the first conductive sheet 27 (the first insulated member 21 and the first conductive sheet 27 may be separated components or insert-molding as a one-piece component). In this embodiment, the first conductive sheet 27 and the first insulated member 21 is combined together by insert-molding process.

Please refer to FIGS. 2 to 6. An inner surface of the first insulated member 21 comprises assembled holes 251. In this embodiment, the inner surface of the first insulated member 21 comprises a plurality of first terminal grooves 23 in a vertical direction for positioning the first plug terminals 3. The first combining block 25 is formed on the inner surface of the first insulated member 21 for retaining the first plug terminals 3. The assembled holes 251 are formed on one side of the first combining block 25 in the vertical direction.

Please refer to FIGS. 2 to 6. In this embodiment, the first plug terminals 3 comprise a plurality of signal terminals 31, at least one power terminal 32, and a plurality of ground terminals 33. Alternatively, the first plug terminals 3 may comprise a plurality of signal terminals 31, at least one power terminal 32, and at least one ground terminal 33.

Please refer to FIGS. 2 to 6. In this embodiment, the second terminal module 4 comprises a second insulated member 41, a plurality of second plug terminals 5, a second combining block 45, and a second conductive sheet 47. The second conductive sheet 47 is a metallic member and is formed on the second insulated member 41. The second conductive sheet 47 is a EMC (Electromagnetic Compatibility) spring which is a shielding strip having EMC spring fingers. The second insulated member 41 is combined with the second conductive sheet 47 (the second insulated member 41 and the second conductive sheet 47 may be separated components or insert-molding as a one-piece component). In this embodiment, the second conductive sheet 47 and the first insulated member 41 is combined together by insert-molding.

Please refer to FIGS. 2 to 6. In this embodiment, an inner surface of the second insulated member 41 comprises a protruding post 451 for mating with the assembled hole 251. In this embodiment, the inner surface of the second insulated member 41 comprises a plurality of second terminal grooves 43 for positioning the second plug terminals 5 in the vertical direction. The second combining block 45 is formed on the inner surface of the second insulated member 41 for retaining the second plug terminals 5. The protruding post 451 is formed on one side of the second combining block 45 in the vertical direction.

Please refer to FIGS. 2 to 6. In this embodiment, the second plug terminals 5 comprise a plurality of signal terminals 51, at least one power terminal 52, and a plurality of ground terminals 53. Alternatively, the second plug terminals 5 may comprise a plurality of signal terminals 51, at least one power terminal 52, and at least one ground terminal 53.

Please refer to FIGS. 2 to 6. In this embodiment, the first insulated member 21 is assembled with the second insulated member 41 to form a tubular structure 6 (as shown in FIG. 1) for being inserted into the receiving cavity 11 of the metallic shell 1. The tubular structure 6 has an insertion cavity 60 for mating with an electrical receptacle connector.

Please refer to FIGS. 2 to 6. In this embodiment, during a first molding process of the first terminal module 2, the first insulated member 21 is combined with the first conductive sheet 27 by insert-molding process, and then the first plug terminals 3 are assembled on the first insulated member 21. During a second molding process, the first combining block 25 is formed on the inner surface of the first insulated member 21 and assembled with the first plug terminals 3, and then the metallic belting connected to the first conductive sheet 27 and the metallic belting connected to the first plug terminals 3 are removed. In addition, the first combining block 25 also can be an individual component assembled on the inner surface of the first insulated member 21 for retaining the first plug terminals 3. After the first insulated member 21 is combined with the first conductive sheet 27 by insert-molding process, the metallic belting connected to the first conductive sheet 27 and the metallic belting connected to the first plug terminals 3 are removed. Then, the first combining block 25 is assembled on the inner surface of the first insulated member 21.

Please refer to FIGS. 2 to 6. In this embodiment, during a first molding process of the second terminal module 4, the second insulated member 41 is combined with the second conductive sheet 47 by insert-molding process, and then the second plug terminals 5 are assembled on the second insulated member 41. During a second molding process, the second combining block 45 is formed on the inner surface of the second insulated member 41 and assembled with the second plug terminals 5, and then the metallic belting connected to the second conductive sheet 47 and the metallic belting connected to the second plug terminals 5 are removed. In addition, the second combining block 45 also can be an individual component assembled on the inner surface of the second insulated member 41. After the second insulated member 41 is combined with the second conductive sheet 47 by insert-molding process, the metallic belting connected to the second conductive sheet 47 and the metallic belting connected to the second plug terminals 5 are removed. Then, the second combining block 45 is assembled on the inner surface of the second insulated member 41.

Please refer to FIGS. 2 to 6. In some embodiments, the first plug terminals 3 comprise a plurality of signal terminals 31, at least one power terminal 32, and at least one ground terminal 33. From a front view of the first plug terminals 3, the first plug terminals 3 comprise, from right to left, a ground terminal 33 (Gnd), a first pair high-speed signal terminals (TX1+–, differential signal terminals), a power terminal 32 (Power/VBUS), a first function detection terminal (CC1, a terminal for inserting orientation detection of the connector and for cable recognition), a pair of low-speed signal terminals (D+–, differential signal terminals), a first reserved terminal (RFU), another power terminal 32 (Power/VBUS), a second pair of high-speed signal terminals (RX2+–, differential signal terminals), and another ground terminal 33 (Gnd).

Please refer to FIGS. 2 to 6. In some embodiments, each of the first plug terminals 3 comprises a flexible contact portion 35, a body portion 36, and a tail portion 37. In this embodiment, the body portions 36 are held in the first combining block 25. The flexible contact portions 35 are extending forward from the body portions 36 in the rear-to-front direction and held in a plurality of first limiting grooves of the first terminal module 2, and the tail portions 37 are extending backward from the body portions 36 in the front-to-rear direction and protruding out of the first combining block 25. Each of the flexible contact portions 35 has a curved profile. The flexible contact portions 35 of the first plug terminals 3 are extending into the insertion cavity 60 for transmitting first signals (e.g., USB 3.0 signals or USB 4.0 signal). The tail portions 37 may be bent horizontally to form flat legs, named legs manufactured by SMT (surface mounted technology), which can be mounted or soldered on the surface of a printed circuit board (PCB) by using surface mount technology. Alternatively, the tail portions 37 may be extending downwardly to form vertical legs, named legs manufactured by through-hole technology, which can be inserted into holes drilled in a printed circuit board.

Please refer to FIGS. 2 to 6. In some embodiments, the second plug terminals 5 comprise a plurality of signal terminals 51, at least one power terminal 52, and at least one ground terminal 53. From a front view of the second plug terminals 5, the second plug terminals 5 comprise, from left to right, a ground terminal 53 (Gnd), a first pair high-speed signal terminals (TX2+–, differential signal terminals), a power terminal 52 (Power/VBUS), a second function detection terminal (CC2, a terminal for inserting orientation detection of the connector and for cable recognition), a pair of low-speed signal terminals (D+–, differential signal terminals), a second reserved terminal (RFU), another power terminal 52 (Power/VBUS), a second pair of high-speed signal terminals (RX1+–, differential signal terminals), and another ground terminal 53 (Gnd).

Please refer to FIGS. 2 to 6. In some embodiments, each of the second plug terminals 5 comprises a flexible contact portion 55, a body portion 56, and a tail portion 57. In this embodiment, the body portions 56 are held in the second combining block 45. The flexible contact portions 55 are extending forward from the body portions 56 in the rear-to-front direction and held in a plurality of second limiting grooves of the second terminal module 4, and the tail portions 57 are extending backward from the body portions 56 in the front-to-rear direction and protruding out of the second combining block 45. Each of the flexible contact portions 55 has a curved profile. The flexible contact portion 55 of the second plug terminals 5 are extending into the insertion cavity 60 for transmitting second signals (e.g., USB 3.0 signals or USB 4.0 signal). The tail portions 57 may be bent horizontally to form flat legs, named legs manufactured by SMT (surface mounted technology), which can be mounted or soldered on the surface of a printed circuit board (PCB) by using surface mount technology. Alternatively, the tail portions 57 may be extending downwardly to form vertical legs, named legs manufactured by through-hole technology, which can be inserted into holes drilled in a printed circuit board.

Please refer to FIGS. 2 to 6. In some embodiments, the first combining block 25 is combined with the body portions 36 of the first plug terminals 3 by insert-molding, and then the second combining block 45 is combined with the body portions 56 of the second plug terminals 5 by insert-molding process. Next, the metallic contact member 8 is assembled between the first combining block 25 and the second combining block 45. Then, the assembly of the metallic contact member 8, the first terminal module 2, and the second terminal module 4 are assembled in the receiving cavity 11 of the metallic shell 1.

Please refer to FIGS. 2 to 6. In some embodiments, the inner surface of the first insulated member 21 has the first limiting grooves at a front portion of the first terminal grooves 23, and the inner surface of the second insulated member 41 has the second limiting grooves at a front portion of the second terminal grooves 43.

Please refer to FIGS. 2 to 6. In some embodiments, the first plug terminals 3 and the second plug terminals 5 are respectively held on the lower surface of the first insulated member 21 (a first mating surface) and the upper surface of the second insulated member 41 (a second mating surface). Moreover, pin-assignments of the first plug terminals 3 and the second plug terminals 5 are point-symmetrical with a central point of the receiving cavity 11 as the symmetrical center. In other words, pin-assignments of the first plug terminals 3 and the second plug terminals 5 have 180-degree symmetrical design with respect to the central point of the receiving cavity 11 as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first plug terminals 3 (or the second plug terminals 5), are rotated by 180 degrees with the symmetrical center as the rotating center, the first plug terminals 3 and the second plug terminals 5 are overlapped. That is, the rotated first plug terminals 3 are arranged at the position of the original second plug terminals 5, and the rotated second plug terminals 5 are arranged at the position of the original first plug terminals 3.

In other words, the first plug terminals 3 and the second plug terminals 5 are arranged upside down, and the pin assignments of the first plug terminals 3 are left-right reversal with respect to that of the second plug terminals 51. Therefore, the electrical plug connector 100 may be inserted into an electrical receptacle connector with a first orientation where the first mating surface is facing down, for transmitting first signals. Conversely, the electrical plug connector 100 may also be inserted into the electrical receptacle connector with a second orientation where the first mating surface is facing up, for transmitting second signals. Furthermore, the specification for transmitting the first signals is conformed to the specification for transmitting the second signals. Note that, the inserting orientation of the electrical plug connector 100 is not limited by the electrical receptacle connector. Furthermore, in this embodiment, the flexible contact portions 35 of the first plug terminals 3 correspond to the flexible contact portions 55 of the second plug terminals 5.

Please refer to FIGS. 2 to 6. In some embodiments, the first conductive sheet 27 is combined with an outer surface of the first insulated member 21, and the second conductive sheet 47 is combined with an outer surface of the second insulated member 41. The first conductive sheet 27 comprises a plurality of first elastic arms inserted into the insertion cavity 60 and a plurality of protruding points contacting an inner surface of the metallic shell 1. The second conductive sheet 47 comprises a plurality of second elastic arms inserted into the insertion cavity 60 and a plurality of protruding points contacting the inner surface of the metallic shell 1.

Figure 10:
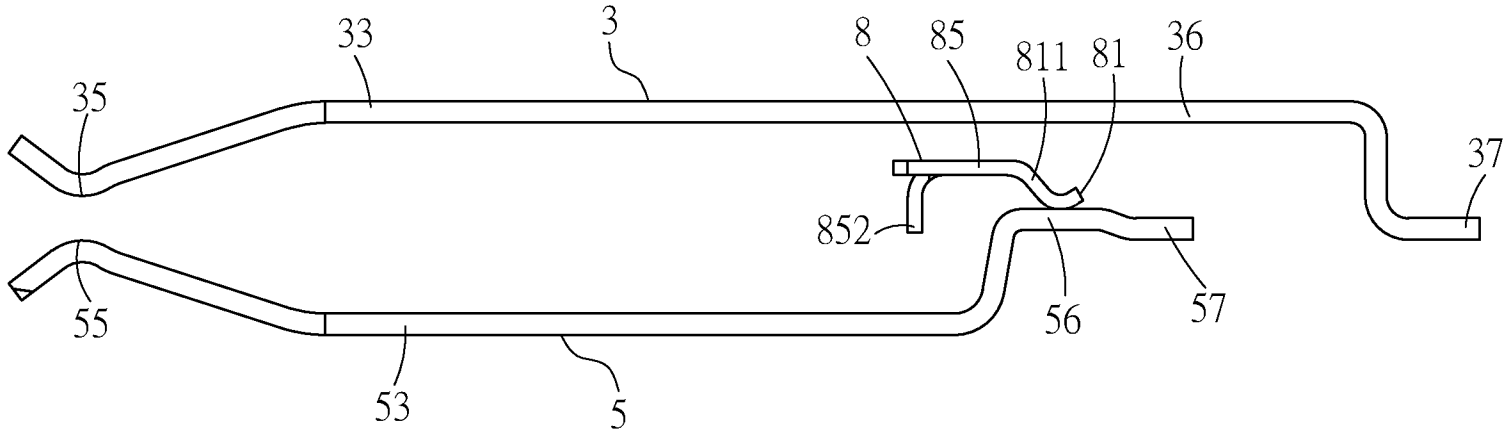
FIG. 10 illustrates a perspective view showing a first embodiment of the contact between the contact member and the second ground terminal, according to the electrical plug connector of the exemplary embodiment.

Please refer to FIGS. 2 to 6 as well as FIG. 10. FIG. 10 illustrates a perspective view showing a first embodiment of the contact between the metallic contact member 8 and the ground terminal 53 of the second plug terminals 5, according to the electrical plug connector 100 of the exemplary embodiment. In some embodiments, the metallic contact member 8 is between the first insulated member 21 and the second insulated member 41. The metallic contact member 8 is between the first plug terminals 3 and the second plug terminals 5. Two ends of the metallic contact member 8 respectively comprise a contact finger 81 contacting each of the ground terminals 33 of the first plug terminals 3 or contacting each of the ground terminals 53 of the second plug terminals 5. In one embodiment, the metallic contact member 8 is laid between twelve first plug terminals 3 and twelve second plug terminals 5, and the contact fingers 81 at the two ends of the metallic contact member 8 are between the left and right outermost first plug terminals 3 of the twelve first plug terminals 3 or between the left and right outermost second plug terminals 5 of the twelve second plug terminals 5.

Figure 9:
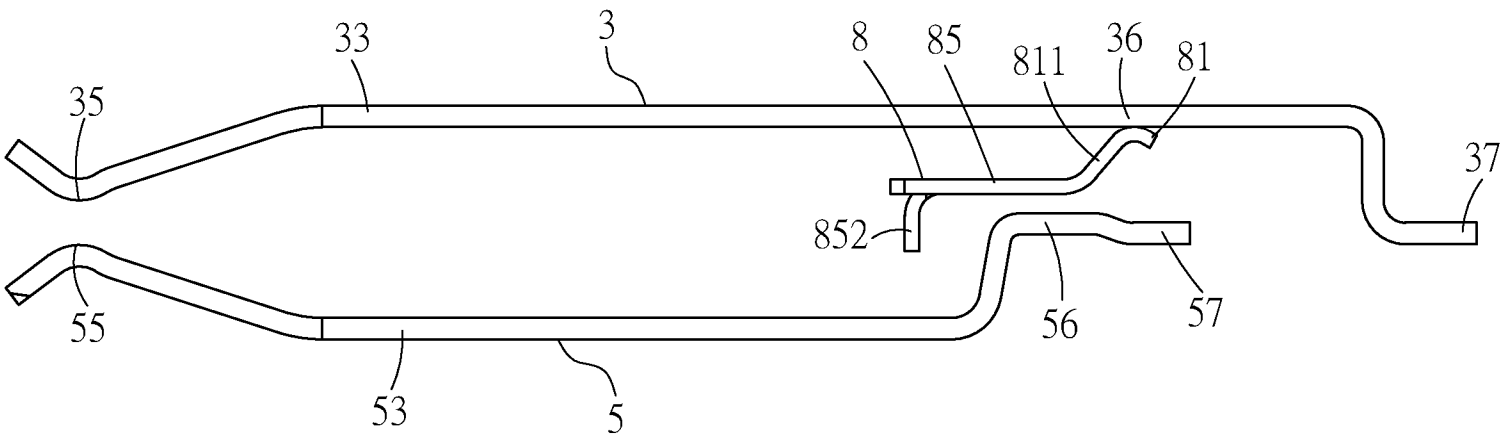
FIG. 9 illustrates a perspective view showing a first embodiment of the contact between the contact member and the first ground terminal, according to the electrical plug connector of the exemplary embodiment.

Please refer to FIGS. 2 to 6. In some embodiments, each of the contact fingers 81 at the two ends of the metallic contact member 8 has an elastic arm 811 extending outwardly. Two ends of the first combining block 25 comprise a plurality of recesses 252 for receiving the elastic arms 811. Moreover, the body portion 36 of each of the ground terminal 33 of the first plug terminals 3 is in contact with the corresponding elastic arm 811 of the metallic contact member 8 (as shown in FIG. 9).

Figure 7:
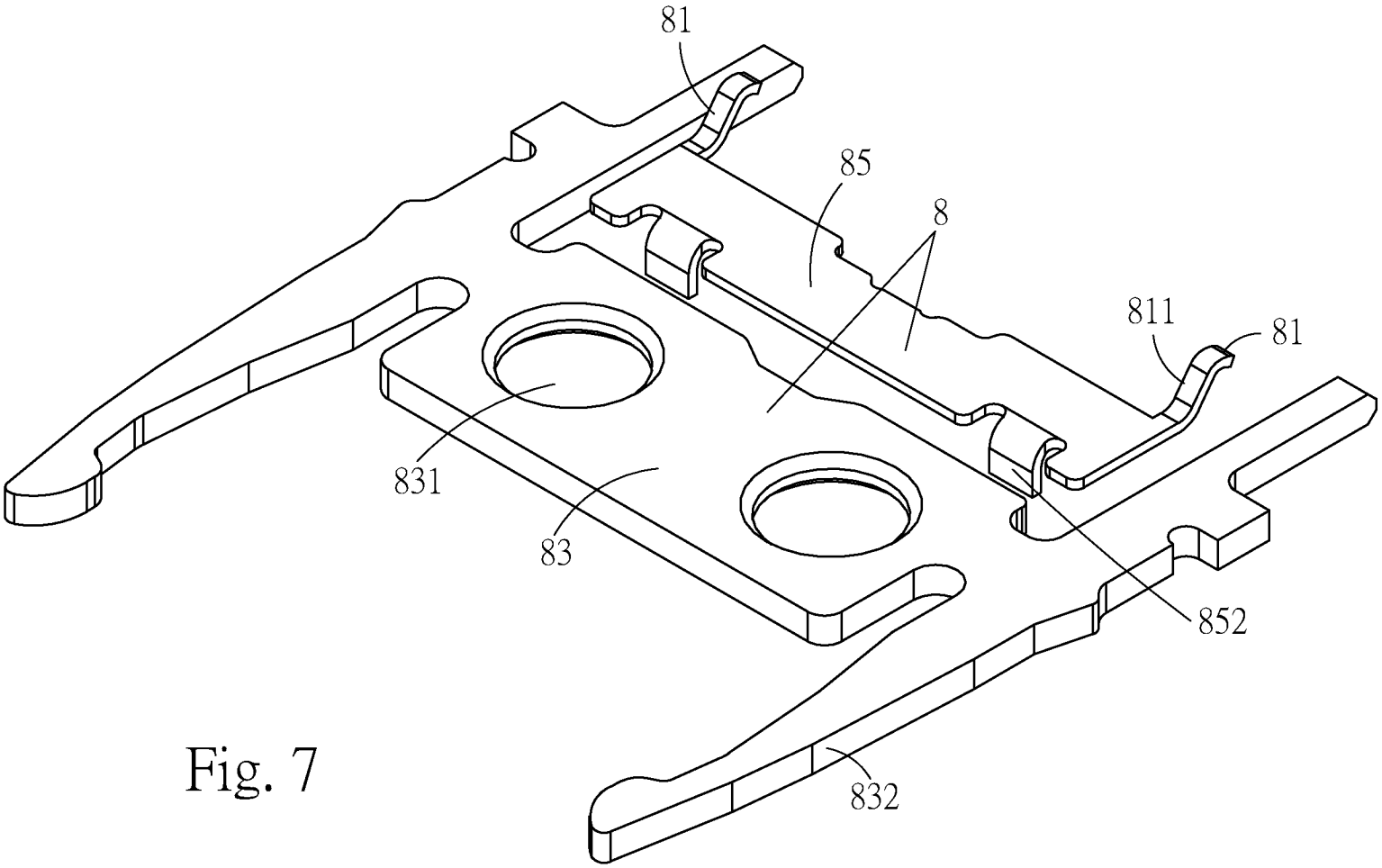
FIG. 7 illustrates a perspective view of a first embodiment of the contact member of the electrical plug connector of the exemplary embodiment.
Figure 8:
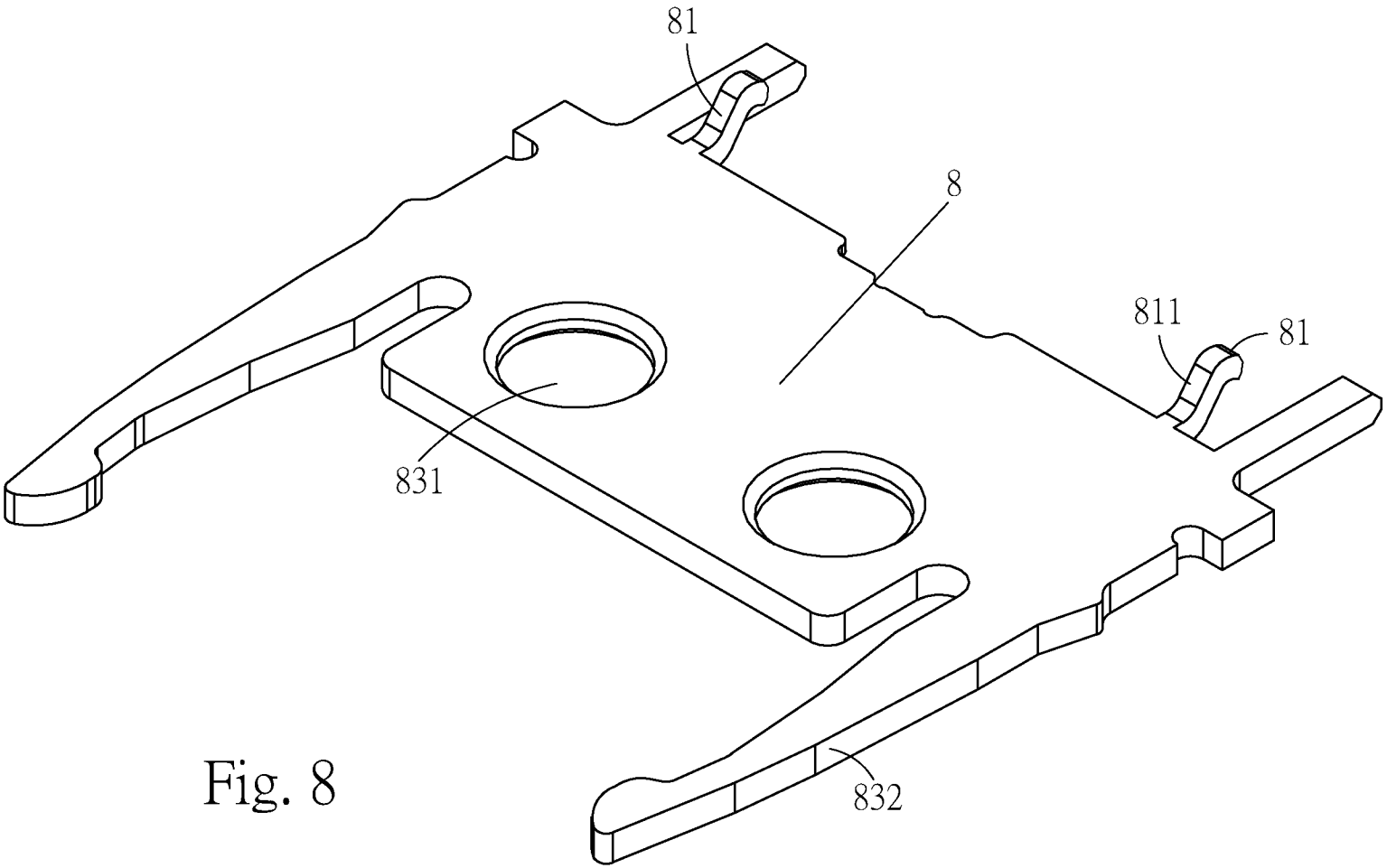
FIG. 8 illustrates a perspective view of a second embodiment of the contact member of the electrical plug connector of the exemplary embodiment.

Please refer to FIGS. 2 to 8. FIG. 7 illustrates a perspective view of a first embodiment of the metallic contact member 8 of the electrical plug connector 100 of the exemplary embodiment. FIG. 8 illustrates a perspective view of a second embodiment of the metallic contact member 8 of the electrical plug connector 100 of the exemplary embodiment. In some embodiments, the metallic contact member 8 comprises a grounding plate 83 and a separation plate 85, and the grounding plate 83 and the separation plate 85 may be formed integrally or separated with each other. The grounding plate 83 is between the first insulated member 21 and the second insulated member 41. The grounding plate 83 has through holes 831 for inserting the protruding posts 451. Two ends of the separation plate 85 respectively comprise the contact fingers 81.

Please refer to FIGS. 2 to 6. In some embodiments, the grounding plate 83 is formed by blanking techniques, but embodiments are not limited thereto. In some embodiments, the grounding plate 83 may be formed by stamping techniques. A grounding plate 83 formed by blanking has a better structural strength than a grounding plate 83 formed by stamping. In addition, the grounding plate 83 comprises a pair of side latches 832. The middle portion of the grounding plate 83 is a rectangular plate and a monolithic metallic shielding plate. Each of the side latches 832 is an elongate pin structure. The side latches 832 are symmetrical with each other, i.e., a first side latch 832 is mirrored with respect to its corresponding second side latch 832. The side latches 832 are extending forwardly from two sides of the middle portion of the grounding plate 83 and sidewardly extending inwardly toward the insertion cavity 60 in a transverse direction perpendicular to the vertical direction for locking with a metallic shielding plate of an electrical receptacle connector into which the electrical plug connector 100 is inserted. Each of the side latches 832 further comprises a locking head, a side arm, and a contact leg. The locking head is at the front portion of each of the side latches 832 for contacting an electrical receptacle connector. The locking head is a hook structure. When the electrical plug connector 100 is inserted into the electrical receptacle connector, the locking heads of the side latches 832 can be used to lock with the metallic shielding plate of the electrical receptacle connector. Moreover, the contact leg is extending outwardly from the rear portion of each of the side latches 832, and the contact legs are respectively extending out of the first insulated member 21 and the second insulated member 41 for contacting a circuit board.

Please refer to FIGS. 2 to 6. In some embodiments, the metallic contact member 8 comprises a plurality of engaging members 852 extending outwardly. At least one of engaging members 852 is in contact with the grounding plate 83. Two ends of the second combining block 45 comprise a plurality of buckling grooves 452 for receiving the engaging members 852. Moreover, the body portion 56 of each of the ground terminal 53 of the second plug terminals 5 is in contact with the corresponding elastic arm 811 of the metallic contact member 8 (as shown in FIG. 10).

Figure 11:
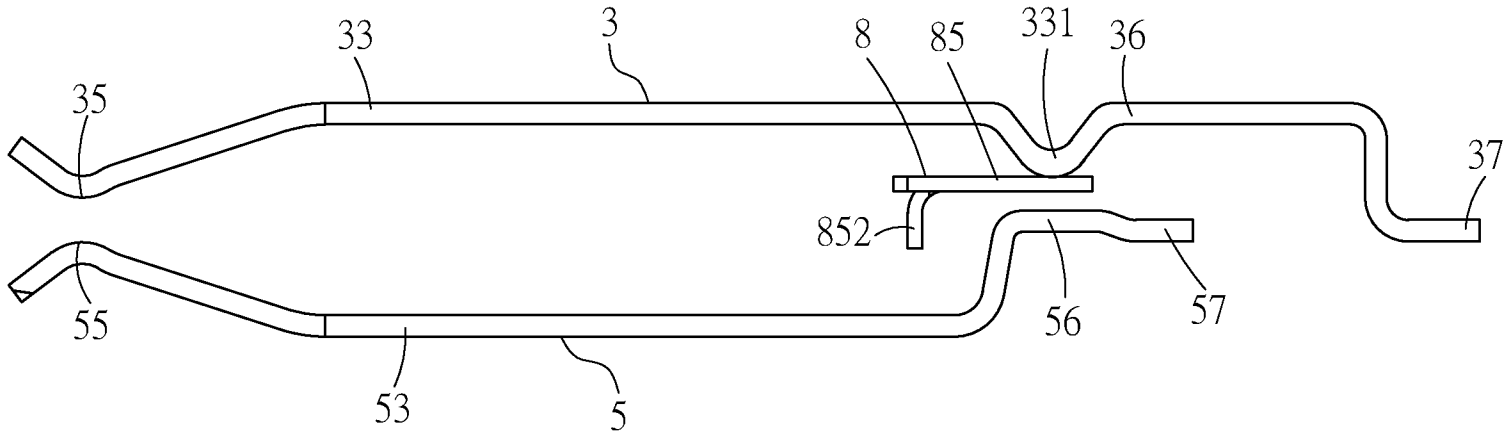
FIG. 11 illustrates a perspective view showing a second embodiment of the contact between the contact member and the first ground terminal, according to the electrical plug connector of the exemplary embodiment.

Please refer to FIGS. 2 to 6 as well as FIG. 11. FIG. 11 illustrates a perspective view showing a second embodiment of the contact between the metallic contact member 8 and the ground terminal 33 of the first plug terminals 3, according to the electrical plug connector 100 of the exemplary embodiment. In some embodiments, each of the ground terminals 33 of the first plug terminals 3 comprises a first bending portion 331 contacting the corresponding contact finger 81. The first bending portion 331 may be a curved portion protruding downwardly at the body portion 36 of each of the ground terminals 33 of the first plug terminals 3 and provided for contacting the metallic contact member 8.

Figure 12:
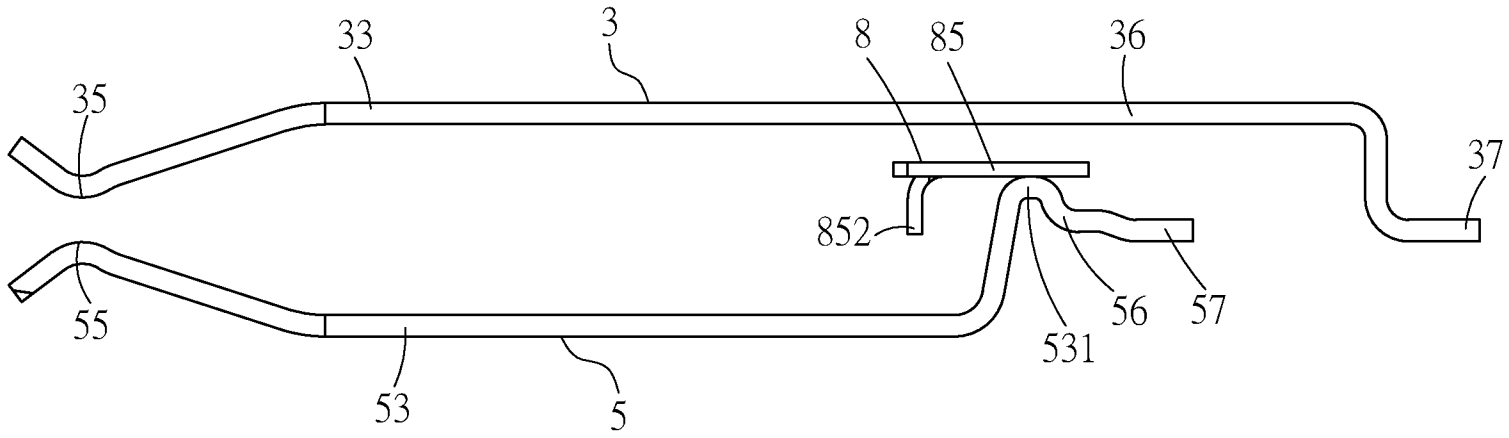
FIG. 12 illustrates a perspective view showing a second embodiment of the contact between the contact member and the second ground terminal, according to the electrical plug connector of the exemplary embodiment.

Please refer to FIGS. 2 to 6 as well as FIG. 12. FIG. 12 illustrates a perspective view showing a second embodiment of the contact between the metallic contact member 8 and the ground terminal 53 of the second plug terminals 5, according to the electrical plug connector 100 of the exemplary embodiment. In some embodiments, each of the ground terminals 53 of the second plug terminals 5 comprises a second bending portion 531 contacting the corresponding contact finger 81. The second bending portion 531 may be a curved portion protruding upwardly at the body portion 56 of each of the ground terminals 53 of the second plug terminals 5 and provided for contacting the metallic contact member 8.

Figure 13:
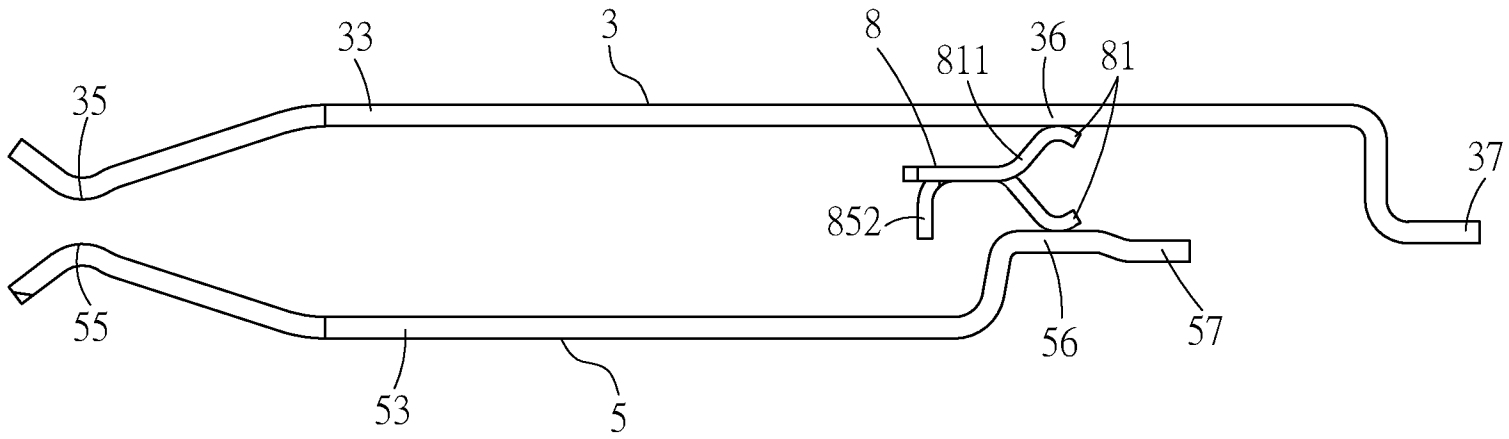
FIG. 13 illustrates a perspective view showing on embodiment of the contact between the contact member, the first ground terminal, and the second ground terminal, according to the electrical plug connector of the exemplary embodiment.

In some embodiments, the two ends of the metallic contact member 8 may be in contact with one ground terminal 33 of the first plug terminal 3 and one ground terminal 53 of the second plug terminal 5 (as shown in FIG. 13). In some other embodiments, the two ends of the metallic contact member 8 may be in contact with two ground terminals 33 of the first plug terminals 3. In some further other embodiments, the two ends of the metallic contact member 8 may be in contact with two ground terminals 53 of the second plug terminals 5. In some embodiments, one of the two ends of the metallic contact member 8 comprises at least one first contact finger 81 contacting the at least one ground terminal 33 of the first plug terminals 3, and the other end of the metallic contact member 8 comprises at least one second contact finger 81 contacting the at least one ground terminal 53 of the second plug terminals 5.

According to one or some embodiment of the instant disclosure, the metallic contact member is between the first insulated member and the second insulated member, and the metallic contact member is also between the first plug terminals and the second plug terminals. Hence, the metallic contact member separates the first plug terminals from the second plug terminals. Furthermore, the two ends of the metallic contact member are respectively in contact with the ground terminals of the first plug terminals or in contact with the ground terminals of the second plug terminals. Accordingly, because of the contact between the metallic contact member and the ground terminal, high-frequency noises can be prevented from resonating with the nearby radio-frequency signals via the grounding loops of the electrical plug connector when the electrical plug connector transmits signals.

Furthermore, the first plug terminals and the second plug terminals are arranged upside down, and the pin-assignment of the flexible contact portions of the first plug terminals is left-right reversal with respect to that of the flexible contact portions of the second plug terminals. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell comprising a receiving cavity;

a first terminal module comprising a first insulated member and a plurality of first plug terminals, wherein an inner surface of the first insulated member comprises a plurality of first terminal grooves for positioning the first plug terminals;

a second terminal module assembled with the first terminal module and received in the receiving cavity, wherein the second terminal module comprises a second insulated member and a plurality of second plug terminals, an inner surface of the second insulated member comprises a plurality of second terminal grooves for positioning the second plug terminals; and a metallic contact member between the first insulated member and the second insulated member, wherein the metallic contact member is between the first plug terminals and the second plug terminals, the metallic contact member comprise a plate, a pair of side latches, and a pair of a contact fingers, wherein each of the pair of the side latches comprises a locking head and a side arm, the side arms are extending forwardly from two sides of the plate and sidewardly extending inwardly toward the insertion cavity in a transverse direction perpendicular to the vertical direction, so that the side arms and the locking heads are adapted to lock with a metallic plate of an electrical receptacle connector into which the electrical plug connector is inserted, and the contact fingers contact first ground terminals of the first plug terminals, or contact second ground terminals of the second plug terminals, or contact one of the first ground terminals of the first plug terminals and one of the second ground terminals of the second plug terminals, and each of the contact fingers is extending outwardly from a front edge of the plate or a rear edge of the plate.

2. The electrical plug connector according to claim 1, wherein each of the contact fingers has an elastic arm extending outwardly.

3. The electrical plug connector according to claim 2, wherein the first insulated member comprises a first combining block formed on the inner surface of the first insulated member to retain the first plug terminals and two ends of the first combining block comprise a plurality of recesses for receiving the elastic arms.

4. The electrical plug connector according to claim 3, wherein each of the first plug terminals comprises a first flexible contact portion, a first body portion, and a first tail portion, each of the first body portions is held in the first combining block, the first body portion of each of the first ground terminals is in contact with the corresponding elastic arm, each of the first flexible contact portions is extending forward from the corresponding first body portion in the rear-to-front direction, each of the first tail portions is extending backward from the corresponding first body portion in the front-to-rear direction and extending out of the first combining block.

5. An electrical plug connector, comprising:

a metallic shell comprising a receiving cavity;

a first terminal module comprising a first insulated member and a plurality of first plug terminals, wherein an inner surface of the first insulated member comprises a plurality of first terminal grooves for positioning the first plug terminals;

a second terminal module assembled with the first terminal module and received in the receiving cavity, wherein the second terminal module comprises a second insulated member and a plurality of second plug terminals, an inner surface of the second insulated member comprises a plurality of second terminal grooves for positioning the second plug terminals; and a metallic contact member between the first insulated member and the second insulated member, wherein the metallic contact member is between the first plug terminals and the second plug terminals, wherein the metallic contact member comprises a plate, a pair of side latches, and a separation plate, the plate and the separation plate are separated with each other, the plate is between the first insulated member and the second insulated member, the separation plate contacts one of first ground terminals of the first plug terminals, or contacts one of second ground terminals of the second plug terminals and each of the pair of the side latches comprises a locking head and a side arm, the side arms are extending forwardly from two sides of the plate and sidewardly extending inwardly toward the insertion cavity in a transverse direction perpendicular to the vertical direction, so that the side arms and the locking heads are adapted to lock with a metallic plate of an electrical receptacle connector into which the electrical plug connector is inserted.

6. The electrical plug connector according to claim 5, wherein the separation plate comprises a plurality of engaging members extending outwardly and at least one of the engaging members is in contact with the plate.

7. The electrical plug connector according to claim 6, wherein the second insulated member comprises a second combining block formed on the inner surface of the second insulated member to retain the second plug terminals and two ends of the second combining block comprise a plurality of buckling grooves for receiving the engaging members.

8. The electrical plug connector according to claim 7, wherein each of the second plug terminals comprises a second flexible contact portion, a second body portion, and a second tail portion, each of the second body portions is held in the second combining block, the second body portion of each of the second ground terminals is in contact with the corresponding elastic arm, each of the second flexible contact portions is extending forward from the corresponding second body portion in the rear-to-front direction, each of the second tail portions is extending backward from the corresponding second body portion in the front-to-rear direction and extending out of the second combining block.

9. The electrical plug connector according to claim 1, wherein each of the first ground terminals comprises a first bending portion contacting the metallic contact member, and each of the second ground terminals comprises a second bending portion contacting the metallic contact member.

10. An electrical plug connector, comprising:

a metallic shell comprising a receiving cavity;

a first terminal module comprising a first insulated member and a plurality of first plug terminals, wherein an inner surface of the first insulated member comprises a plurality of first terminal grooves in a vertical direction for positioning the first plug terminals;

a second terminal module assembled with the first terminal module and received in the receiving cavity, wherein the second terminal module comprises a second insulated member and a plurality of second plug terminals, an inner surface of the second insulated member comprises a plurality of second terminal groove in the vertical direction for positioning the second plug terminals; and a metallic contact member between the first insulated member and the second insulated member, wherein the metallic contact member is between the first plug terminals and the second plug terminals, the metallic contact member comprises at least one contact finger, the at least one contact finger contacts one of first ground terminals of the first plug terminals or one of second ground terminals of the second plug terminals, the metallic contact member further comprises a plate and a separation plate, the plate further comprises a pair of side latches, each of the pair of the side latches comprises a locking head and a side arm, the side arms are extending forwardly from two sides of the plate and sidewardly extending inwardly toward the insertion cavity in a transverse direction perpendicular to the vertical direction, so that the side arms and the locking heads are adapted to lock with a metallic plate of an electrical receptacle connector into which the electrical plug connector is inserted.

11. The electrical plug connector according to claim 10, wherein the separation plate comprises the at least one contact finger and the at least one contact finger contacts one of the first ground terminals or one of the second ground terminals.

12. The electrical plug connector according to claim 11, wherein the separation plate comprises at least one engaging member extending outwardly and the at least one engaging member is in contact with the plate.

13. The electrical plug connector according to claim 10, wherein the first insulated member comprises a first combining block formed on the inner surface of the first insulated member to retain the first plug terminals and two ends of the first combining block comprise a plurality of recesses for receiving the at least one contact finger.

14. The electrical plug connector according to claim 10, wherein the separation plate comprises a plurality of engaging members extending outwardly and at least one of the engaging members is in contact with the plate.

15. The electrical plug connector according to claim 14, wherein the second insulated member comprises a second combining block formed on the inner surface of the second insulated member to retain the second plug terminals and two ends of the second combining block comprise a plurality of buckling grooves for receiving the engaging members.

16. The electrical plug connector according to claim 10, wherein the first insulated member comprises a first combining block formed on the inner surface of the first insulated member to retain the first plug terminals, the second insulated member comprises a second combining block formed on the inner surface of the second insulated member to retain the second plug terminals, a pair of protruding posts and a pair of assembled holes are respectively formed on one side of the first combining block and one side of the second combining block in the vertical direction, and the plate has through holes for inserting the protruding posts and the pair of protruding posts and the pair of assembled holes are mated with each other to assemble the first insulated member, the plate, and the second insulated member together.

17. The electrical plug connector according to claim 10, further comprises a first conductive sheet and a second conductive sheet, wherein the first conductive sheet is combined with an outer surface of the first insulated member, the second conductive sheet is combined with an outer surface of the second insulated member, the first conductive sheet comprises a plurality of first elastic arms inserted into the insertion cavity, and the second conductive sheet comprises a plurality of second elastic arms inserted into the insertion cavity.

18. The electrical plug connector according to claim 17, wherein the first conductive sheet further comprises a plurality of protruding points contacting an inner surface of the metallic shell and the second conductive sheet further comprises a plurality of protruding points contacting the inner surface of the metallic shell.

19. The electrical plug connector according to claim 1, wherein the inner surface of the first insulated member comprises a plurality of assembled holes, the inner surface of the second insulated member comprises a plurality of protruding posts are protruding upwards from the second insulated member, and the plate has a plurality of through holes for inserting the protruding posts respectively, and the protruding posts and assembled holes are mated with each other to assemble the first insulated member, the plate, and the second insulated member together.

20. The electrical plug connector according to claim 5, wherein the inner surface of the first insulated member comprises a plurality of assembled holes, the inner surface of the second insulated member comprises a plurality of protruding posts are protruding upwards from the second insulated member, and the plate has a plurality of through holes for inserting the protruding posts respectively, and the protruding posts and assembled holes are mated with each other to assemble the first insulated member, the plate, and the second insulated member together.

* * * * *